US007543658B2

(12) United States Patent
Russell et al.

(10) Patent No.: US 7,543,658 B2
(45) Date of Patent: Jun. 9, 2009

(54) DIRECTIONAL DRILLING CONTROL

(75) Inventors: Michael King Russell, Cheltenham (GB); Colin Walker, Cheltenham (GB)

(73) Assignee: Russell Oil Exploration Limited, Cheltenham (GB)

( * ) Notice: Subject to any disclaimer, the term of this patent is extended or adjusted under 35 U.S.C. 154(b) by 3 days.

(21) Appl. No.: 11/672,995

(22) Filed: Feb. 9, 2007

(65) Prior Publication Data

US 2007/0181343 A1 Aug. 9, 2007

(30) Foreign Application Priority Data

Feb. 9, 2006 (GB) ..... 0602623.1

(51) Int. Cl.
*E21B 7/08* (2006.01)

(52) U.S. Cl. ..... 175/73; 175/45; 175/61; 175/74

(58) Field of Classification Search ..... 175/73, 175/45, 74, 61
See application file for complete search history.

(56) References Cited

U.S. PATENT DOCUMENTS 3,713,500 A 1/1973 Russell
3,841,420 A 10/1974 Russell
6,059,050 A 5/2000 Gray
6,129,160 A 10/2000 Williams et al.
2004/0238222 A1* 12/2004 Harrison ..... 175/61

* cited by examiner

*Primary Examiner*—Giovanna C Wright
(74) *Attorney, Agent, or Firm*—Fleit Gibbons Gutman Bongini & Bianco PL; Paul D. Bianco; Martin Fleit

(57) ABSTRACT

Drilling means for directional drilling in a bore hole comprising a drill pipe and a drilling head, including a slippable clutch device linking the drill pipe and said drilling head such that torque due to rotation of said drill pipe can be controllably applied to said drilling head through at least partial engagement of said clutch, and control means operable to sense an actual orientation angle of said drilling head and compare said actual orientation angle with a required orientation angle adjustably set in said control means and to control said slippable clutch such that when the actual orientation angle and the required orientation angle are the same, the slip torque of the slipping clutch equals the motor reaction torque, so maintaining the orientation angle of the drilling tool at said required orientation angle.

15 Claims, 2 Drawing Sheets

DIRECTIONAL DRILLING CONTROL

FIELD OF THE INVENTION

The invention relates to directional drilling and to means for drilling and for directional control of drilling with a drilling assembly mounted at a lower end of a drill pipe or "string".

BACKGROUND OF THE INVENTION

U.S. Pat. No. 3,713,500 relates to the alteration of the orientation of a drilling assembly by arranging for the drilling head to be rotatable relative to the end of a drill pipe. U.S. Pat. No. 3,841,420 describes means for holding the drilling assembly against the drill rotation torque by the use of a clutch mechanism or a torque balancing force, and to avoid having a conductor wireline in the drilling pipe, the wireline having to be wound up to add a new length of pipe, which is time consuming and also to enable the drill pipe to be rotating whilst drilling to minimise longitudinal friction and to better control weight on the bit. Both these specifications relate to the steering of a drill bit angled relative to the pipe centreline to maintain the angle such that the bit is steered in the desired direction against the tendency of the bit to wander, due to the reaction on the motor body of the motor driving the bit. U.S. Pat. No. 3,841,420 discloses a mud pressure operated hydraulic clutch and electrical operation thereof by a relay controlled by a measuring unit.

SUMMARY OF THE INVENTION

The present invention comprises a drilling assembly for attachment to the lower end of a drill pipe, for directional drilling in a bore hole, wherein the rotational orientation of the drilling head determines the deviation angle of the bore hole, comprising means for attachment of the drilling assembly to said lower end of a drill pipe, a bearing by means of which said drilling assembly is in use rotatably carried by said drill pipe allowing relative rotation of said drilling assembly relative to said drill pipe, a bit-driving motor mounted in said drilling assembly and a drilling bit coupled to the motor to be driven thereby so that when said drilling bit is loaded in use said drilling assembly is subjected to a motor reaction torque tending to rotate drilling assembly to change the orientation thereof, a slippable clutch device linking the drill pipe to said drilling assembly such that torque due to the rotation of said drill pipe can be controllably applied to said drilling assembly by at least partial engagement of said clutch, and control means operable to sense an actual orientation angle of said drilling assembly and compare said actual orientation angle with a required orientation angle adjustably set in said control means and to control said slippable clutch such that when the actual orientation angle and the required orientational angle are the same the slip torque of the slipping clutch equals the motor reaction torque, so maintaining the orientation angle of the drilling assembly at said required orientation angle.

Preferably the slipping clutch is a hydraulically loaded multi-plate clutch.

Electrical energy for said control means may be provided by batteries in said drilling assembly.

There may be provided a swash plate hydraulic pump used to drive a load piston of the clutch device, return of the hydraulic fluid being made via an electrically controlled spool valve which has a force feedback piston arranged such that a force on the spool of the valve is balanced by the feedback piston. The valve spool is driven from an electromagnetic force motor such that the clutch load is proportional to the force motor current.

Desirably the control means for determining the actual orientation angle includes fluxgates and accelerometers.

DETAILED DESCRIPTION OF THE INVENTION

Figure 1:
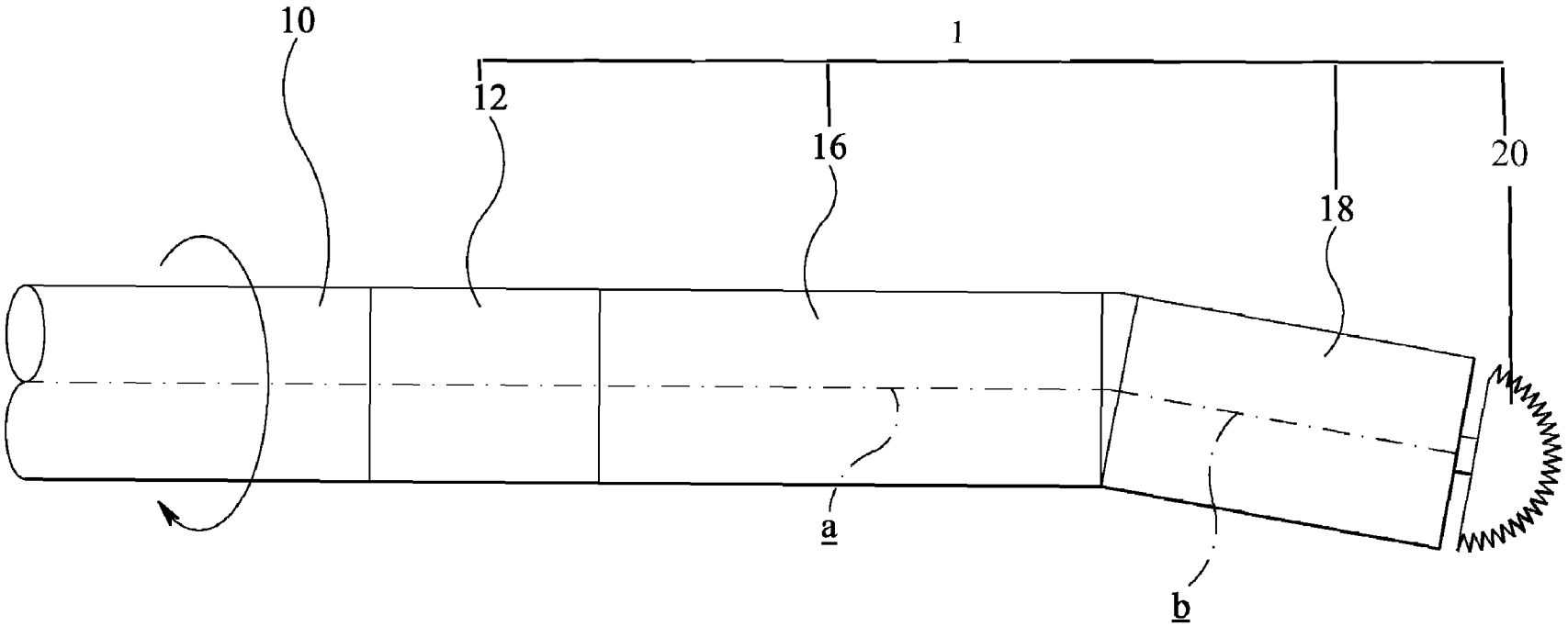
FIG. 1 is a schematic diagram showing a general arrangement of drilling means according to the invention.

The invention will now be described by way of example only and with reference to the accompanying drawings in which:

In FIG. 1 there is provided a drill pipe shown partially as 10 and mounted for rotation thereon is a slippable clutch device 12 forming part of a drilling assembly which also comprises control means 16 and a bent housing including a hydraulic (mud) motor which drives the drill bit 20. It will be noted that the longitudinal axis b of the bent housing and the axis of rotation of the drilling tool 20 is angled relative to the longitudinal axis a of the drilling head 1 and drill pipe 10. This follows known constructions in which the angle is used to determine the direction of deviation of the bore hold.

Rotation of the drill bit 20 causes a reaction on the housing 18 which tends to rotate the drilling head 1 around the axis a tending to alter the angular orientation at which the drill bit 20 is working. The slipping clutch device 12 isolates the rotation of the drill pipe 10 (typically 60 rpm) from the drilling head 1 in normal circumstances. The tendency of the drilling bit to wander is caused by the reaction torque of the drill bit on the motor in the bent housing 18. This has to be counteracted by a compensating torque which is derived from the rotation of the drill pipe 10 by allowing partial slippage of the clutch 12. The control means 16 includes fluxgates and accelerometers to sense the actual orientation of the drill bit 20 and compares this with a required orientation angle set in the control means in 16. If the two differ then this triggers means of controlling the slippable clutch 12 in order to provide transmission of extra torque from the drill pipe 10 to the drilling assembly in order to compensate. In the position where the drilling assembly is at the required orientation angle then the difference between the required orientation angle and the actual orientation angle is zero and in this position the slip torque transmitted by the slipping clutch equals the motor reaction torque. This is the "normal" position. Any deviation from this position will result in a difference signal being generated by the control means 16 which will act on the slipping clutch to allow for a compensating torque change so that the slip torque will differ from the motor reaction torque. It will then try to re-establish the correct orientation angle of the drilling head 1 and when this occurs the different signal will disappear and the normal position will resume.

Figure 2:
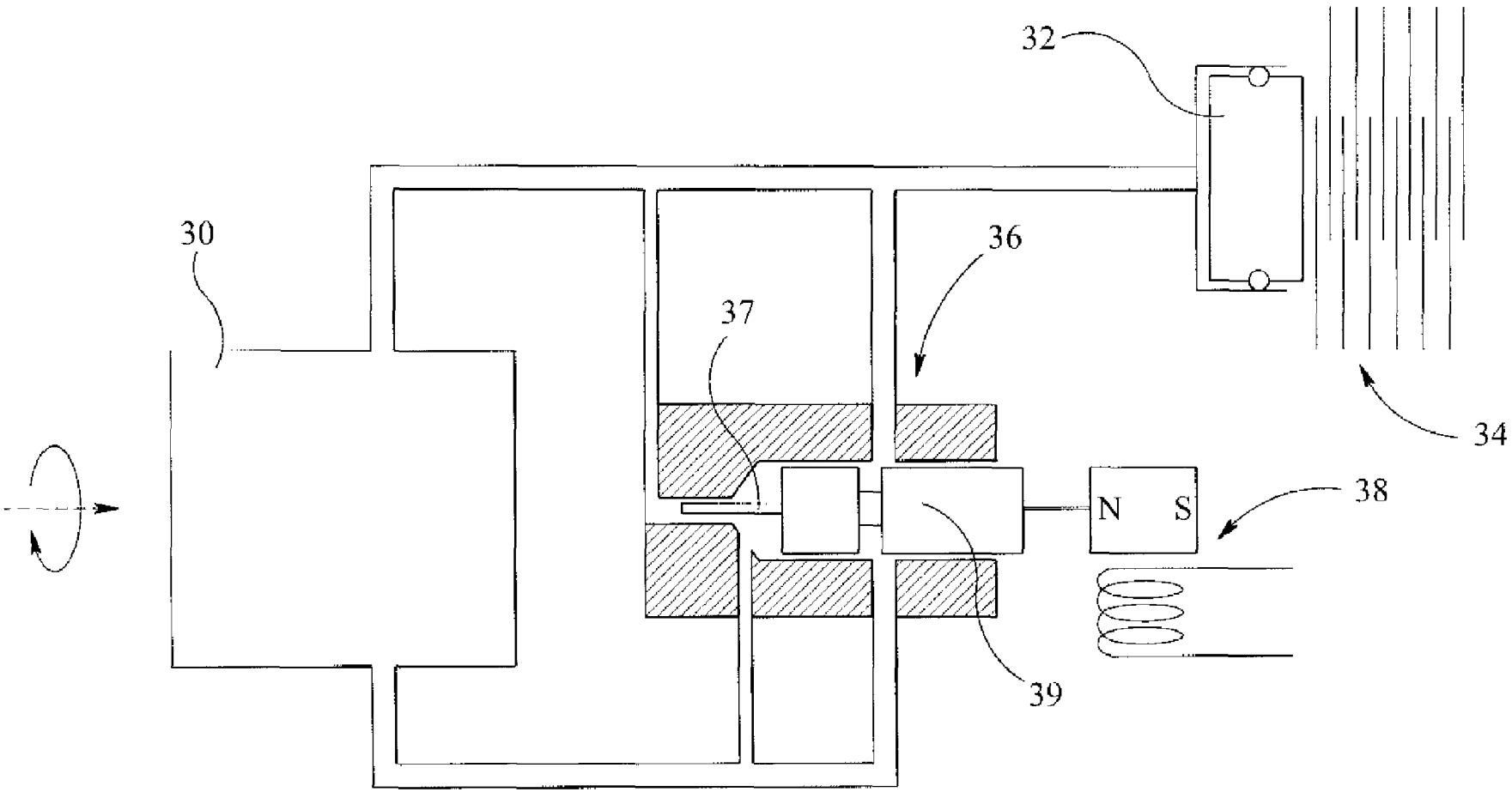
FIG. 2 is a schematic diagram of part of the control means for the drilling means of the invention.

FIG. 2 shows a part of the control means. A swash plate hydraulic pump 30 which is driven by relative movement of the drill pipe relative to the drilling assembly produces a pressurised hydraulic fluid which is used inter alia to operate a clutch load piston 32 of a multi-plate clutch shown generally as 34. The return path of hydraulic fluid from the clutch is made through an electrically-controlled spool valve shown generally as 36 with a force feedback piston 37 such that a force on the valve spool is balanced by the feedback piston.

The valve spool 39 is driven by an electromagnetic force motor shown generally as 38 and the net effect of the arrangement is that the clutch load is proportional to the force motor current. The force motor current is supplied from the control means and when this is at a normal level i.e. there is no difference signal between the sensed orientation angle and the required orientation angle, the clutch load piston is at such a position that the slip torque transmitted by the clutch equals the motor reaction torque. If a difference signal is generated then the force motor current changes and the load on the clutch load piston changes to modify the multi-plate clutch slip torque and return the difference signal to zero.

The invention claimed is:

1. A drilling means for directional drilling in a bore hole comprising a drill pipe, a drilling head, wherein rotational orientation of the drilling head determines a deviation angle of the bore hole, the drilling head including a slippable clutch for coupling the drilling head to the drill pipe such that torque due to rotation of said drill pipe can be controllably applied to said drilling head through at least partial engagement of said clutch, control means comprising a sensor for mounting on the drilling head operable to sense an actual orientation angle of said drilling head and compare said actual orientation angle with a required orientation angle adjustably set in said control means and to control said clutch such that when the actual orientation angle and the required orientation angle are the same, slip torque of the clutch equals motor reaction torque maintaining the orientation of the drilling head at said required orientation angle, and a hydraulic pump for driving a load piston of the clutch, wherein the pump includes an electrically controlled hydraulic control valve for controlling hydraulic loading applied to the load piston by the pump in dependence on the orientation of the drilling head in order to maintain the drilling head at the required orientation.

2. The drilling means of claim 1, in which the clutch is a hydraulically loaded multi-plate clutch.

3. The drilling means of claim 1, in which the drilling head further includes a drilling bit and a motor for rotating the drilling bit, wherein the motor is powered by relative motion between said drill pipe and said drilling head.

4. The drilling means of claim 1, further including a generator disposed in said drilling head, wherein the generator is driven by relative rotation between said drill pipe and said drilling head to generate electrical power.

5. The drilling means of claim 1, in which the hydraulic pump is driven by relative motion between said drill pipe and said drilling head.

6. The drilling means of claim 1, further including batteries disposed in said drilling head, wherein the batteries provide electrical energy for the control means.

7. The drilling means of claim 1, in which the control means further includes flux gates and accelerometers.

8. The drilling means of claim 1, wherein the hydraulic pump is a swash plate hydraulic pump.

9. The drilling means of claim 1, wherein the control valve is an electrically controlled spool valve.

10. The drilling means of claim 9, wherein the control valve has a force feedback piston arranged such that a force on a spool member of the valve is balanced by a force on the feedback piston in operation.

11. The drilling means of claim 1, wherein the control valve is driven by an electromagnetic force motor such that hydraulic loading applied to the load piston is proportional to force motor current which is dependent on orientation of the drilling head.

12. A drilling means for directional drilling in a bore hole comprising a drill pipe, a drilling head, including a clutch device linking the drill pipe and the drilling head such that torque due to rotation of said drill pipe can be controllably applied to said drilling head through at least partial engagement of said clutch, control means operable to sense an actual orientation angle of said drilling head and compare said actual orientation angle with a required orientation angle adjustably set in said control means and to control said clutch such that when the actual orientation angle and the required orientation angle are the same, slip torque of the clutch equals motor reaction torque maintaining the orientation angle of the drilling tool at said required orientation angle, and a swash plate hydraulic pump used to drive a load piston of the clutch, return of hydraulic fluid being made via an electrically controlled spool valve which has a force feedback piston arranged such that a force on the spool is balanced by the feedback piston, and the spool is driven from an electromagnetic force motor to maintain a clutch load proportional to force motor current.

13. A drilling means for directional drilling in a bore hole comprising a drill pipe for rotation during drilling, a drilling head, carried by the drill pipe at a required rotational orientation during drilling, wherein rotational orientation of the drilling head determines a required deviation angle of the bore hole, the drilling head including a clutch for coupling the drilling head to the drill pipe such that torque due to rotation of said drill pipe can be controllably applied to said drilling head, and control means comprising a sensor mounted on the drilling head operable to sense an actual orientation angle of said drilling head and to provide an output signal indicative of the actual orientation angle, and a hydraulically operated clutch actuator mounted on the drilling head operable to control said clutch in dependence on said output signal to controllably compensate for motor reaction torque during drilling so as to maintain drilling of the bore hole at the required deviation angle.

14. The drilling means of claim 13, wherein the clutch actuator comprises a hydraulic pump for driving a load piston of the clutch.

15. The drilling means of claim 14, wherein the clutch actuator further comprises an electrically controlled hydraulic control valve for controlling hydraulic loading applied to the load piston by the pump in dependence on said output signal from the sensor.

* * * * *